US006779695B2

(12) United States Patent
Matkovich

(10) Patent No.: US 6,779,695 B2
(45) Date of Patent: Aug. 24, 2004

(54) GARMENT HANGER

(75) Inventor: Mario Matkovich, Williamstown (AU)

(73) Assignee: The Hanger Manufacturing Co. Pty, Ltd., Victoria (AU)

( * ) Notice: Subject to any disclaimer, the term of this patent is extended or adjusted under 35 U.S.C. 154(b) by 20 days.

(21) Appl. No.: 10/093,846

(22) Filed: Mar. 8, 2002

(65) Prior Publication Data

US 2002/0158091 A1 Oct. 31, 2002

(30) Foreign Application Priority Data

Mar. 9, 2001 (AU) ..... PR3644

(51) Int. Cl.[7] ..... A41D 27/22
(52) U.S. Cl. ..... 223/93; 223/96
(58) Field of Search ..... 223/93, 90, 91, 223/96

(56) References Cited

U.S. PATENT DOCUMENTS

| | | | | |
|---|---|---|---|---|
| 2,872,088 A | | 2/1959 | Katz | 223/91 |
| 3,209,966 A | | 10/1965 | Wach | 223/93 |
| 3,317,096 A | | 5/1967 | Bissonnette et al. | 223/95 |
| 3,487,984 A | | 1/1970 | Loscalso | 223/96 |
| 3,964,651 A | | 6/1976 | Hamilton et al. | 223/91 |
| 4,623,079 A | | 11/1986 | Tendrup et al. | 223/85 |
| 5,092,502 A | | 3/1992 | Kolton et al. | 223/91 |
| 5,236,109 A | | 8/1993 | Zuckerman | 223/96 |
| 5,297,706 A | * | 3/1994 | Blitz | 14/19 |
| 6,065,652 A | | 5/2000 | Dooling-Sherman | 223/93 |
| 6,196,430 B1 | | 3/2001 | Gouldson | 223/96 |
| 2001/0015361 A1 | | 8/2001 | Gouldson | 223/85 |

FOREIGN PATENT DOCUMENTS

| | | | |
|---|---|---|---|
| AU | 629976 B | 10/1992 | A47G/25/48 |
| GB | 2258610 A | 2/1993 | A47G/25/48 |

* cited by examiner

*Primary Examiner*—John J. Calvert
*Assistant Examiner*—James Smith
(74) *Attorney, Agent, or Firm*—Finnegan, Henderson, Farabow, Garrett & Dunner, LLP

(57) ABSTRACT

This invention relates to a garment hanger 10 having an elongate hanger bar 20 and a centrally positioned hook member 12. Garment holding means are located at opposed ends 14, 16 of the hanger bar 20. Each garment holding means includes a first jaw 30 and a second jaw 40, the second jaw 40 being moveable relative to the first jaw 30. Each garment holding means also including locking means 50 for selectively holding the second jaw 40 in a position adjacent the first jaw 30. The ability of the garment hanger 10 to selectively clamp the second jaw 40 in a position so as to hold a garment between the first and second jaws 30, 40 is a particular advantage.

24 Claims, 4 Drawing Sheets

GARMENT HANGER

RELATED APPLICATION(S)

This application priority under 35 U.S.C. § 119 and/or 120 to:

Australian Patent Application No. PR3644 filed Mar. 9, 2001.

INTRODUCTION

The present invention is directed to the field of plastic moulded garment hangers. It has particular application to garment hangers designed to carry lingerie and other delicate or lightweight items of clothing, but is also applicable for use with heavier items such as shorts, trousers, T-shirts etc.

BACKGROUND

Garment hangers are used to hang clothing, and are commonly made in moulded form of plastic materials. Lingerie hangers in particular are often made of polystyrene material, which has the advantage that it can be manufactured clear in colour and is very lightweight, but such hangers are generally relatively brittle so can be subject to breakage when undue force is applied to them.

Some garment hangers involve a simple one-piece moulded construction, while others may involve multiple pieces connected together for the purposes of modular identification or to form complex clip or clamp attachments to hold items of clothing securely to the hanger. A popular lingerie hanger includes a simple one-piece construction and retains garments by means of spring action between cooperating shaped tongue elements at each end. Although adequate in many applications, the spring action alone is not always sufficient to retain garments. Furthermore, if the spring clip is designed to retain simultaneously a plurality of articles (or a single article of considerable thickness) it will then be unable to hold a single item or an item of significantly reduced thickness. Moreover, the weight of garments can often cause inadvertent release from me spring clip.

Garment hangers may additionally or alternatively utilise metal clips to provide reinforcement of plastic elements. These hangers can be complex to assemble and/or relatively expensive to produce.

Garment hangers with clips or clamps tend to require significant effort to open and close the clip, often requiring a two-handed operation. This can be a disadvantage in loading a garment onto a hanger, and moreover the garment may risk being damaged due to the force required to open or dose the clip or clamp.

Many garment hangers with clips or clamps rely on a retaining mechanism in the form of a hinge orientated to rotate about an axis in line with the longitudinal direction of the garment hanger. These garment hangers can be relatively expensive to produce, and are far from ideal for many applications, particularly in the case of lingerie hangers.

SUMMARY OF THE INVENTION

It is an object of this invention to provide a garment hanger that at least partially addresses one or more of the inconveniences of the prior art.

According to this invention there is provided a garment hanger including:

an elongate hanger bar with two opposed ends;

a suspension means connected to the elongate hanger bar for suspending the bar from a support;

a garment holding means at each opposed end for holding garments to the hanger, each said garment holding means including:

a first jaw associated with and extending from the elongate hanger bar;

a second jaw associated with and extending from said elongate hanger bar being pivotable about an axis substantially perpendicular to the longitudinal axis of the elongate hanger bar, such that the second jaw is selectively movable relative to the first jaw between a first position in which the garment can be introduced between the first and second jaws, and a second position in which the garment is held between the first and second jaws; and locking means to selectively clamp the second jaw in the second position.

The invention will be disclosed herein with reference to the hanger in normal use, whereby the hanger is in a suspended orientation with the suspension means on the upper side of the elongate hanger bar of the hanger. Terms such as "upward" and "downward" or "top" and "bottom" should be construed in light of this throughout this specification and claims. It will be appreciated that the garment holding means at each end of the elongate hanger bar can be arranged in a variety of different orientations relative to the elongate hanger bar.

The garment hanger of the invention provides a significant advantage over the spring clip type lingerie hangers and clamp hangers of the prior art. More particularly, the locking end clamps provided by the garment holding means feature a mechanism that pivots outwardly, which greatly facilitates use of the hanger without involving significant cost implications. The invention affords the provision of a lightweight hanger which is able to effectively and reliably grip garments of a wider range of designs, thicknesses and weights, including multiple garments.

Preferably the first jaw is fixed in position relative to the hanger bar and the second jaw is moveable relative to the hanger bar between the first position and the second position. Further, the second jaw is positioned outwardly of the hanger bar relative to the first jaw such that movement of the second jaw relative to the first jaw is in an inward direction towards the first jaw. Movement of the second jaw in an outward direction away from the first jaw is preferably limited by the locking means. Preferably, movement of the locking means to clamp the second jaw in the second position moves the second jaw inward towards the first jaw.

In one preferred embodiment, the locking means extends from and is moveable relative to the elongate hanger bar to engage the second jaw. The locking is preferably integrally formed with the hanger bar having a flexible arm extending from the hanger bar with an end portion being engagable with the second jaw, whereby movement of the locking means is achieved by flexure of the flexible arm. A movement limiter associated with the hanger bar may be provided for limiting movement of the locking means relative to the hanger bar. Preferably the locking means cooperates with an outer edge of the second jaw, the locking means and outer edge of the second jaw being provided with complementary forms to positively engage when the second jaw is in the second position. It is preferred that the second jaw be formed integrally with the elongate hanger bar, having an integrally formed hinge portion about which the second jaw pivots relative to the first jaw. Further the second jaw is preferably prestressed to bias it towards the first position.

According to another preferred embodiment of the invention the locking means is formed separately from the elongate hanger bar being pivotally connected to the hanger bar. The locking means may be pivotally connected to the elongate hanger bar by means of a hinge pin extending from the hanger bar received by a hinge recess on the locking means. Guide means associated with the first and second jaw may be provided for guiding movement of the second jaw relative to the first jaw, The guide means preferably include a tongue projecting from the second jaw which is received by a guide track in the first jaw. A pivot limiter may be provided for limiting pivoting movement of the locking means, the pivot limiter having at least one pin extending transversely of the hanger bar being received in at least one elongate recess of the locking means. The locking means preferably cooperates with an outer edge of the second jaw, the locking means and outer edge of the second jaw being provided with complementary forms to positively engage when the second jaw is in the second position. Further, the second jaw is preferably formed integrally with the elongate hanger bar, having an integrally formed hinge portion about which the second jaw pivots relative to the first jaw. It is preferred that the second jaw be prestressed to bias it towards the first position.

According to further still another preferred embodiment of this invention the second jaw and locking means are integrally formed, the locking means being pivotally connected to the elongate hanger bar. It is preferred that the locking means be pivotally connected to the hanger bar by means of a hinge pin extending from the hanger bar received by a hinge recess on the locking means. The locking means may include a flexible bridging hinge element extending between the first and second jaws and having a two position bias corresponding to the first and second positions of the second jaw.

BRIEF DESCRIPTION OF THE DRAWINGS

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

In the drawings.

DETAILED DESCRIPTION

Figure 4:
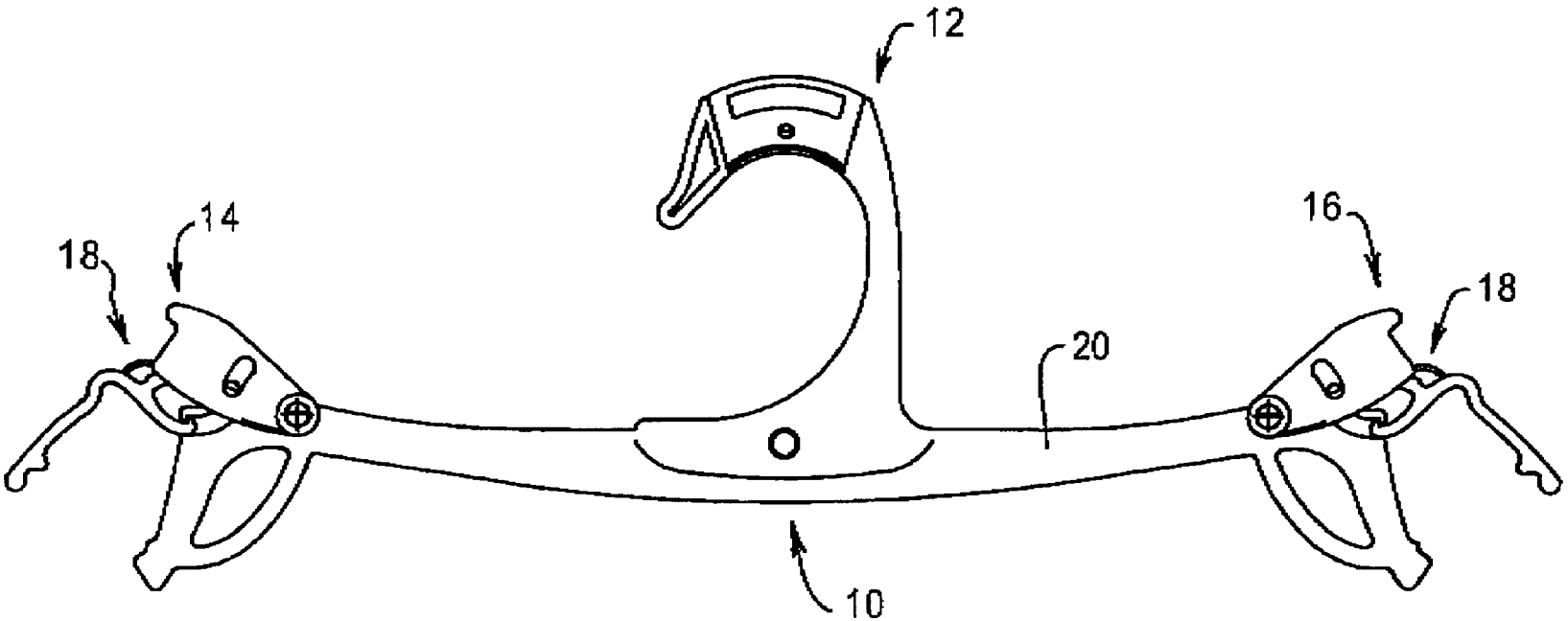
FIG. 4 represents an overall view of a garment hanger according to the invention in normal use orientation.

A suspended garment hanger 10 (for example, a lingerie hanger) is shown in front elevation in FIG. 4, and has conventionally a centrally positioned hook member 12 integrally moulded to an essentially elongate hanger bar 20 of I-beam profile, the latter featuring a pair of coplanar oppositely directed ends 14 and 16, each end terminating in a garment holding means 18 providing a clamp for suspending one or more garments. As the figure shows, elongate hanger bar 20 may be slightly bowed in form, such that ends 14 and 16 are positioned in use slightly higher than the level of the central part of bar 20. In this way, when used with an item such as a pair of shorts, the waistband of the shorts will completely hide bar 20 and part of hook member 12, which adds to the visual appeal of the displayed item in a store.

Figure 1A:
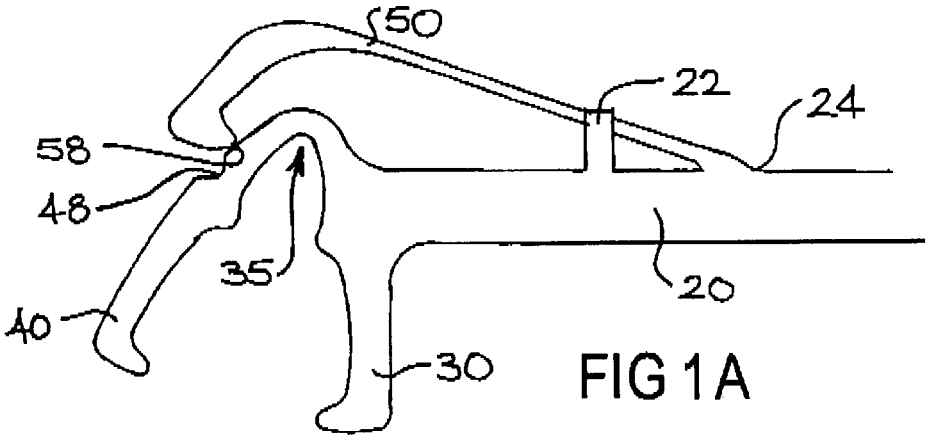
FIG. 1A is a front elevation representation of part of a garment hanger according to an embodiment of the invention with the end clamp in an open position.
Figure 1B:
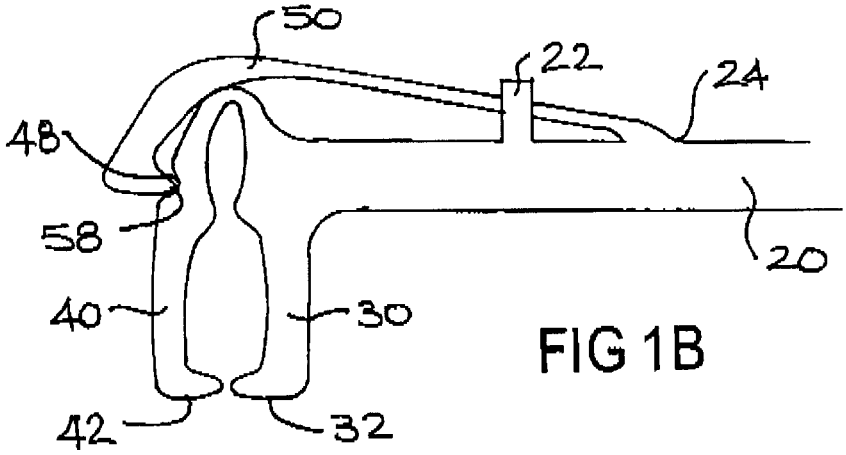
FIG. 1B shows the clamp of FIG. 1A in a closed position.
Figure 1C:
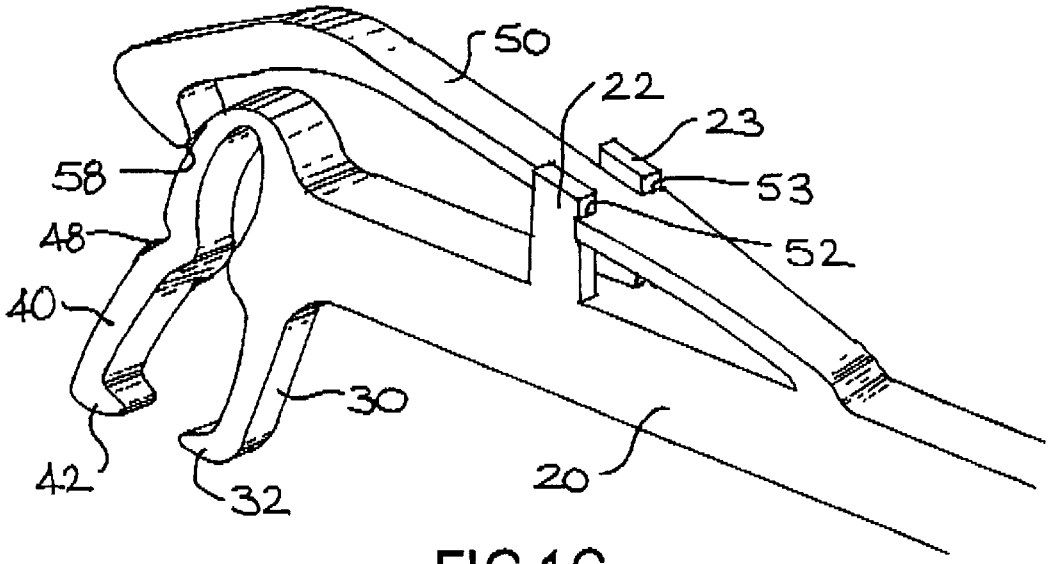
FIG. 1C is a front elevation perspective representation of the hanger of FIG. 1A.

The hanger of the first embodiment of the invention, shown in FIGS. 1A, 1B and 1C, is of simple one-piece moulded construction. The garment holding means of the hanger features at end 14 of elongate hanger bar 20 a downwardly depending inner jaw 30 and a downwardly depending outer jaw 40, both formed as integral parts of the hanger with elongate hanger bar 20. Inner jaw 30 is maintained in a fixed downward orientation relative to bar 20 by virtue of its form, whilst outer jaw 40 is connected to bar 20 by way of integral hinge portion 35 such that arm 40 is able to rotate outwardly about this hinge. Arm 40 is provided with a lateral notch 48 as shown part way along its outer edge. In a first position (FIG. 1A), jaws 30 and 40 are therefore separated to allow a garment or a number of garments to be introduced between them, whilst in a second position (FIG. 1B) the jaws are brought together to close the garment holding means and thereby hold the garment or garments.

To selectively move and clamp jaw 40 into the second, closed position, a clamping arm 50 is provided as shown, also formed integrally with the hanger. This clamping arm 50 has a generally elongate stem form projecting from the upper side of bar 20 of the hanger at a hinge 24 positioned at a distance from hanger end 14, and terminating in a generally downwardly directed end portion having an inwardly directed detent projection 58. Side posts 22 and 23 are also formed integrally with hanger bar 20 and project from the upper side of bar 20 on opposite sides of the stem of clamping arm 50 (FIG. 1C) to restrain clamping arm 50 from undesirable movement out of the general plane of the hanger structure (ie. out of the plane of the paper of FIGS. 1A and 1B). The stem of clamping arm 50 is formed with two opposed shoulder portions 52 and 53 which are positioned to abut against the sides of posts 22 and 23 in use, in such a way that outwardly directed force on clamping arm 50 is not carried solely by hinge 24, but also by posts 22 and 23. Clamping arm 50 may additionally feature two integrally moulded planar side webs (not shown) extending downwardly from each side of the arm to enclose at least the upper portions of jaws 30 and 40 and so minimise movement of the jaws out of the general plane of the hanger structure.

When fabricated, outer jaw 40 is moulded in an open position (FIG. 1A), so that it will tend preferentially to move to its outward (open) position, thus opening the garment holding means absent any restraint or other force applied to it.

In use, a garment (or a number of garments) is introduced between jaws 30 and 40 in the open position, and a simple downwardly directed pressure applied to clamping arm 50. This lowers clamping arm 50 and so moves detent projection 58 down the outer edge of jaw 40 to finally engage and latch in notch 40, thus urging jaw 40 to rotate inwardly about hinge 35 and move towards jaw 30, engaging and holding the garment(s) in a clamped manner. The lower free end portions 32 and 42 of jaws 30 and 40 respectively may feature serrations or teeth to assist in securely retaining the garment(s). Alternatively or additionally, one or both of jaws 30 and 40 may be provided with a generally meandering shaping to increase their flexibility, so enabling them more readily to accommodate different thicknesses of garment material.

To release the garment from the hanger, an upward force on the outermost part of clamping arm 50 is applied, releasing the latching action and allowing outer jaw 40 to return to its open position. The simple construction and the manner of selectively opening and closing the garment holding means provides a very reliable holding action on one or a number of garments, and permits very easy operation. The operator loading or unloading a hanger may hold the hanger with each hand adjacent to one of the hanger ends and use the thumbs or index fingers to simultaneously manipulate clamping arms 50 at each end. This avoids the need for a two-handed operation at each end of the hanger when loading and unloading.

Figure 2A:
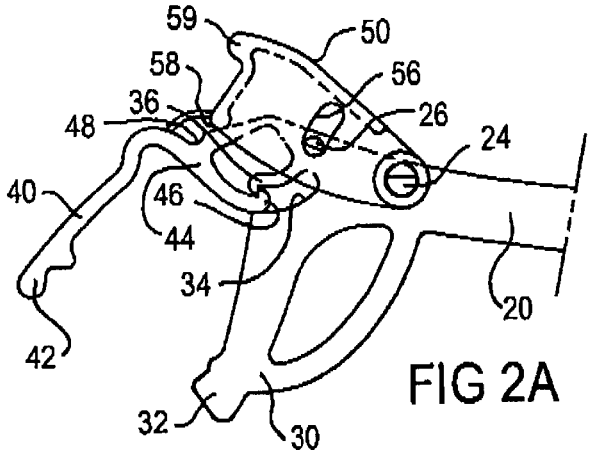
FIG. 2A is a front elevation representation of part of a garment hanger according to a further embodiment of the invention with the end clamp in an open position.
Figure 2B:
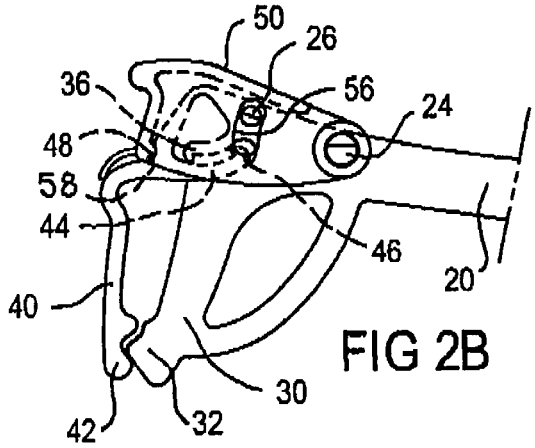
FIG. 2B shows the clamp of FIG. 2A in a closed position.
Figure 2C:
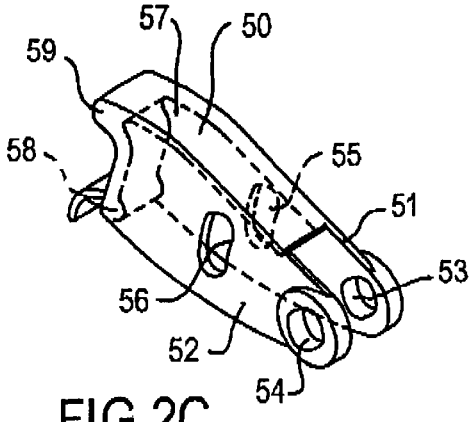
FIG. 2C is a perspective representation of the locking means of the hanger of FIG. 2A.

The second embodiment of the invention, shown in FIGS. 2A, 2B and 2C, employs a two-part construction to form the garment holding means. The first part comprises inner and outer jaws 30 and 40 formed integrally with the hanger, whilst the second part comprises a clamping element 50 described in further detail below. This enables different materials to be used to form the different parts with a view to minimising cost and maximising hanger life. For example, a polystyrene material can be used to manufacture the hanger and jaws 30, 40, whilst a more flexible plastics material such as polyethylene can be used for clamping element 50.

As shown in FIG. 2A, inner jaw 30 and outer jaw 40 are formed integrally with elongate hanger bar 20, and once again an integral hinge connects outer law 40 with elongate hanger bar 20 to allow the pivoting movement of this jaw. Outer jaw 40 again features on its outermost edge a recess 48, and the braced shaping of inner jaw 30 ensures minimum flexing of this part of the hanger relative to elongate hanger bar 20 when the hanger is in use. Outer jaw 40 is formed with an inwardly directed, arcuate elongate projecting tongue 44 which carries a locking tooth 46 at its free end, whilst inner jaw 30 is formed with a complementary outwardly directed, arcuate elongate cutout 34 having a locking tooth 36 at or close to its mouth, as shown in FIG. 2A, When moulded, outer jaw 40 is in the position shown in FIG. 2A, but when it is first manipulated to approach inner jaw 30 the free end of tongue 44 enters the mouth of cutout 34 and the teeth 46 and 36 interengage to hold tongue 44 within cutout 34. In this way, the cooperation of elements 44 and 34 provides a guide track for the movement of outer jaw 40 in use, and furthermore teeth 46 and 36 limit the extent of outward movement of outer jaw 40. The shape memory of the plastics material used ensures that, absent any closing force, outer jaw will spring reliably and repeatably to this outermost position.

As noted above, locking element 50 is moulded as a separate element to be clipped onto elongate hanger bar 20, and comprises two opposed lateral walls 51 and 52 joined over a part of their edges by upper peripheral wall 57, as shown in detail in FIG. 2C. Two small pivot holes 53 and 54 are provided, one on each lateral wall 51, 52, to engage with two opposed pivot studs 24 formed on the lateral faces of hanger bar 20. Each wall 51, 52 is further provided with an elongate hole 55 and 56 to cooperate with two opposed stop pins 26 which project from the lateral faces of hanger bar 20. This ensures that, when locking element 50 is clipped onto hanger bar 20 by way of pivot points 24, 53, 54, and urged downwardly into its operating position, the extent of its movement relative to elongate hanger bar 20 is determined by the travel of stop pins 26 in holes 55 and 56.

Locking element 50 is shaped to include an outwardly projecting nib part 59 for ease of operation. Further, upper peripheral wall 57 continues downwardly on the outer side of locking means 50 to support an inwardly directed detent projection 58 shaped and positioned to cooperate with recess 48 in use. In overall form, then, locking element 50 provides a partial housing for jaws 30 and 40, preventing unwanted movement out of the general plane of the hanger and guiding and limiting the movement of the clamp elements.

Figure 2D:
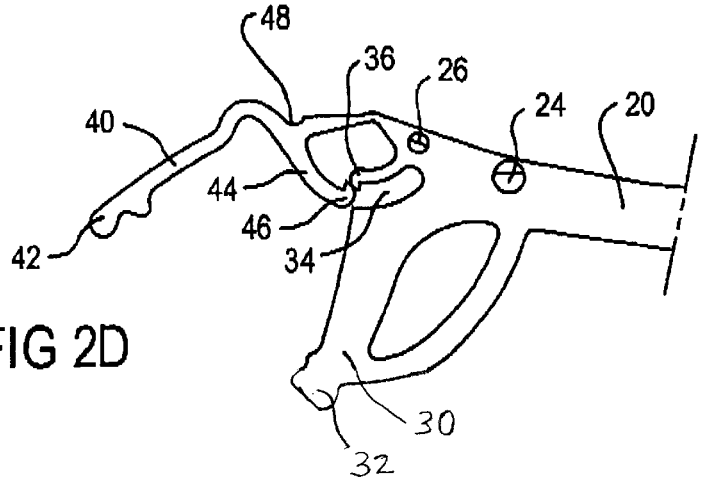
FIG. 2D is a first elevation representation of the clamp of FIG. 2A without the locking means of FIG. 2C.

FIG. 2D shows the inner and outer jaws 30 and 40 (the first part of the construction) of FIG. 2A, with the locking element 50 (the second part of the construction) removed.

In assembly, outer jaw 40 is first depressed to engage locking tooth 46 with locking tooth 36. Locking element 50 is then introduced and clipped into position on pivot studs 24, holes 55 and 56 clipping over pins 26. In operation, a downward pressure applied to locking element 50 pushes outer jaw 40 downwardly and inwardly by way of the action of the outer part of wall 57 on the outer edge of jaw 40. Tongue 44 moves along the guide track provided by cutout 34, and the free ends of jaws 30 and 40 come together to secure a garment introduced therebetween. Finally, detent projection 58 engages in recess 48 and the clamp is thus secured in position, pins 26 being then located in the uppermost part of elongate holes 55 and 56.

To release the garment, an upward pressure is applied by the fingers or thumbs to the nib part 59 of the locking element, lifting detent projection 58 out of recess 48. The resilience of the integral hinge of outer jaw 40 causes this jaw then to spring back to the outer, open position, the interoperation of teeth 46, 36 providing the limit of this movement, and the interoperation of pins 26 and holes 55, 56 limiting the upward pivoting of locking element 50. The particular design of this embodiment of the invention provides a particularly reliable and robust device, which remains extremely simple to operate.

Figure 3A:
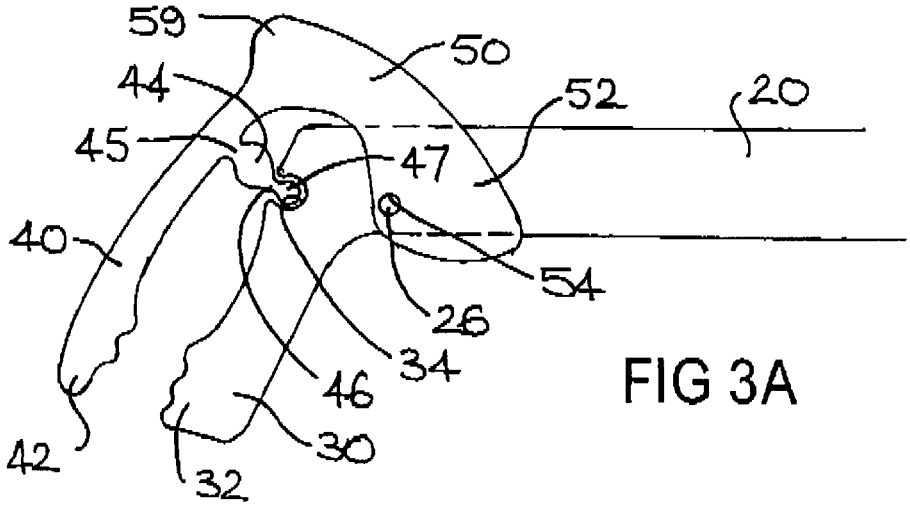
FIG. 3A is a front elevation representation of part of a garment hanger according to yet a further embodiment of the invention with the end clamp in an open position.
Figure 3B:
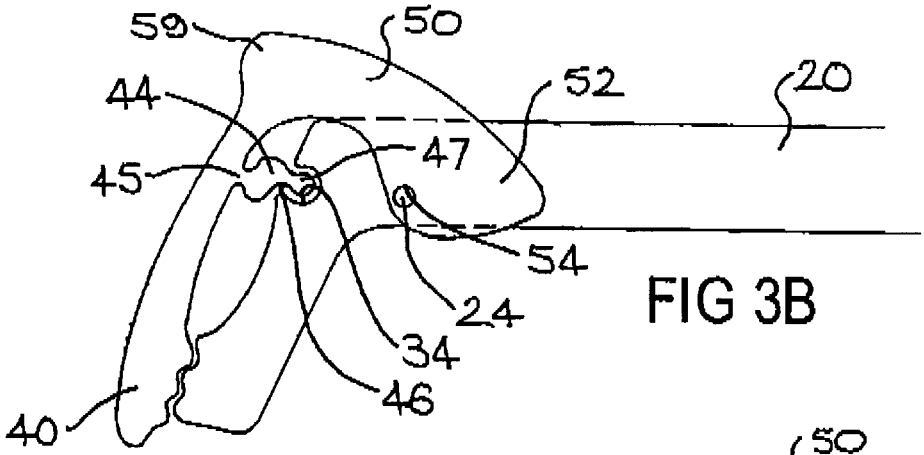
FIG. 3B shows the clamp of FIG. 3A in a closed position.
Figure 3C:
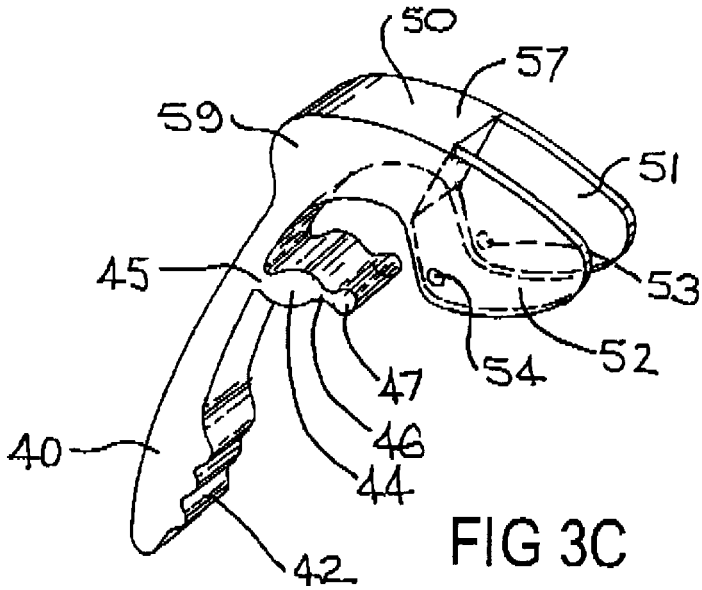
FIG. 3C is a perspective representation of the locking means of the hanger of FIG. 3A.

Turning to the embodiment of the invention represented in FIGS. 3A, 3B and 3C, this also employs a two-part construction to form the garment holding means at each end of the hanger.

Inner jaw 30 is again integrally moulded to the hanger, and outer jaw 40 is moulded as a separate element. In this embodiment, the locking means is provided by a part of the outer jaw 40, as will be described in more detail below.

Inner jaw 30 is formed with a part cylindrical recess 34 at the upper part of its inner edge, whilst outer jaw 40 is formed with an inwardly directed flexible projecting tongue 44 which has two spaced integral hinge portions 45 and 46 and terminates in a part cylindrical end portion 47. As explained further below, tongue 44 serves to provide a flexible bridging hinge element spanning the gap between jaws 30 and 40.

As shown in FIG. 3C, outer jaw 40 connects to element 50 which has two opposed lateral walls 51 and 52 joined over a part of their edges by upper peripheral wall 57. Two small pivot holes 53 and 54 are provided, one on each lateral wall 51, 52 to engage with two opposed pivot studs 24 formed on the lateral faces of hanger bar 20. Element 50 is shaped to include an outwardly projecting nib part 59 for ease of operation. Element 50 may be integrally formed with outer jaw 40, or alternatively may be moulded separately and affixed thereto by gluing or welding.

In assembly, element 50 is clipped onto elongate bar 20, by positioning pivot holes 53 and 54 over pins 24. Outer jaw is then moved towards inner jaw 30 so that end portion 47 of tongue 44 is engaged into and held within part cylindrical recess 34. In the open position, then (FIG. 3A), it is possible to introduce one or more items of clothing into the space between inner jaw 30 and outer jaw 40. In this position projecting tongue 44 occupies a first bias position in which it is in a relaxed state and outer jaw 40 is thus firmly held in that open position.

In operation, downward pressure is applied to projecting nib 59, which causes element 50 and outer jaw 40 to rotate about pivot pin 24. As end portion 47 is held to pivot within recess 34, the rotation of element 50 causes bending of tongue 44 about flexible hinges 45 and 46. As outer jaw 40 rotates, tongue 44 moves through a stressed state, and continued movement of outer jaw 40 allowing tongue 44 to then preferentially move into a second relaxed state corresponding to outer jaw 40 arriving in its inner, closed position. In this inner position, jaws 30 and 40 serve to securely retain one or more garments of clothing.

To release the garment, upwards pressure is applied to projecting nib 59 to rotate element 50 upwardly about pivot pin 24. Again tongue 44 bends about its flexible hinges 45 and 46 until outer jaw 40 is returned to its first position, where tongue 44 returns to a relaxed state. It is clear then, that the locking means of this embodiment relies upon the two-position bias mechanism provided by the particular design of the bridging element formed by tongue 44.

The hanger of this embodiment is manufactured from two different materials, the major part of the hanger (being the hanger body 20 and inner jaw 30) made from polystyrene, clamping element 50 being made from nylon material, which is relatively flexible and robust and has good shape memory.

It will be apparent from the foregoing description that the present invention provides a simple and inexpensive yet effective arrangement for hanging a garment. The ability to selectively clamp the second jaw in position so as to hold the garment between the first and second jaws is a particular advantage.

Various alterations, modifications and/or additions may be introduced into the constructions and arrangements of parts previously described without department from the spirit or ambit of the invention as defined by the appended claims.

What is claimed is:

1. A garment hanger including:

an elongate hanger bar with two opposed ends:

a suspension means connected to the elongate hanger bar for suspending the bar from a support;

a garment holding means at each opposed end for holding garments to the hanger, each said garment holding means including:

a first jaw associated with and extending from the elongate hanger bar;

a second jaw associated with and extending from said elongate hanger bar being pivotable about an axis substantially perpendicular to the longitudinal axis of the elongate hanger bar, such that the second jaw is selectively movable relative to the first jaw between a first position in which the garment can be introduced between the first and second jaws, and a second position in which the garment is held between the first and second jaws; and locking means to selectively clamp the second jaw in the second position.

2. A garment hanger according to claim 1, wherein the first jaw is fixed in position relative to the hanger bar and the second jaw is movable relative to the hanger bar between the first position and the second position.

3. A garment hanger according to claim 1 or 2, wherein the second jaw is positioned outwardly of the hanger bar relative to the first jaw such that movement of the second jaw relative to the first jaw is in an inward direction towards the first jaw.

4. A garment hanger according to claim 3, wherein movement of the second jaw in an outward direction away from the first jaw to a fully open position is limited by the locking means.

5. A garment hanger according to claim 4, wherein movement of the locking means to clamp the second jaw in the second position moves the second law from its fully open position inward towards the first jaw.

6. A garment hanger according to claim 5, wherein the locking means extends from and is movable relative to the elongate hanger bar to engage with the second jaw.

7. A garment hanger according to claim 6, wherein the locking means is integrally formed with the hanger bar having a flexible arm extending from the hanger bar with an end portion being engagable with the second jaw, whereby movement of the locking means is achieved by flexure of the flexible arm.

8. A garment hanger according to claim 7, including a movement limiter associated with the hanger bar for limiting pivoting movement of the locking means relative to the hanger bar.

9. A garment hanger according to claim 8, wherein the locking means cooperates with an outer edge of the second jaw, the locking means and outer edge of the second jaw being provided with complementary forms to positively engage when the second jaw is in the second position.

10. A garment hanger according to claim 9, wherein the second jaw is formed integrally with the elongate hanger bar, having an integrally formed hinge portion about which the second jaw pivots relative to the first jaw.

11. A garment hanger according to claim 10, wherein the second jaw is prestressed to bias it towards the first position.

12. A garment hanger according to claim 5, wherein the locking means is formed separately from the elongate hanger bar being pivotally connected to the hanger bar.

13. A garment hanger according to claim 12, wherein the locking means is pivotally connected to the elongate hanger bar by means of a hinge pin extending from the hanger bar received by a hinge recess on the locking means.

14. A garment hanger according to claim 13, including guide means associated with the first and second jaw for guiding movement of the second jaw relative to the first jaw.

15. A garment hanger according to claim 14, wherein the guide means including a tongue projecting from the second jaw received by a guide track in the first jaw.

16. A garment hanger according to claim 15, including a pivot limiter for limiting pivoting movement of the locking means, the pivot limiter having at least one pin extending transversely of the hanger bar being received in at least one elongate recess of the locking means.

17. A garment hanger according to claim 16, wherein the locking means cooperates with an outer edge of the second jaw, the locking means and outer edge of the second jaw being provided with complementary forms to positively engage when the second jaw is in the second position.

18. A garment hanger according to claim 17, wherein the second jaw is formed integrally with the elongate hanger bar, having an integrally formed hinge portion about which the second jaw pivots relative to the first jaw.

19. A garment hanger according to claim 18, wherein the second jaw is prestressed to bias it towards the first position.

20. A garment hanger according to claim 5, wherein the second jaw and locking means are integrally formed, the locking means being pivotally connected to the elongate hanger bar.

21. A garment hanger according to claim 20, wherein the locking means is pivotally connected to the elongate hanger bar by means of a hinge pin extending from the hanger bar received by a hinge recess on the locking means.

22. A garment hanger according to claim 21, wherein the locking means includes a flexible bridging hinge element extending between the first and second jaws and having a two position bias corresponding to the first and second positions of the second jaw.

23. A garment hanger including:

an elongate hanger bar with two opposed ends:

a suspension means connected to the elongate hanger bar for suspending the bar from a support;

a garment holding means at each opposed end for holding garments to the hanger, each said garment holding means including:

a first jaw associated with and extending from the elongate hanger bar;

a second jaw associated with and extending from said elongate hanger bar being pivotable about an axis substantially perpendicular to the longitudinal axis of the elongate hanger bar, such that the second jaw is selectively movable relative to the first jaw between a first position in which the garment can be introduced between the first and second jaws, and a second position in which the garment is held between the first and second jaws; locking means to selectively clamp the second jaw in the second position, and a movement limiter associated with the hanger bar for limiting pivoting movement of the locking means relative to the hanger bar.

24. A garment hanger including:

an elongate hanger bar with two opposed ends:

a suspension means connected to the elongate hanger bar for suspending the bar from a support;

a garment holding means at each opposed end for holding garments to the hanger, each said garment holding means including:

a first jaw associated with and extending from the elongate hanger bar;

a second jaw associated with and extending from said elongate hanger bar being pivotable about an axis substantially perpendicular to the longitudinal axis of the elongate hanger bar, such that the second jaw is selectively movable relative to the first jaw between a first position in which the garment can be introduced between the first and second jaws, and a second position in which the garment is held between the first and second jaws; and locking means to selectively clamp the second jaw in the second position, wherein the locking means is pivotally connected to the elongate hanger bar by means of a hinge pin extending from the hanger bar received by a hinge recess on the locking means.

* * * * *

UNITED STATES PATENT AND TRADEMARK OFFICE

CERTIFICATE OF CORRECTION

PATENT NO. : 6,779,695 B2
DATED : August 24, 2004
INVENTOR(S) : Mario Matkovich

It is certified that error appears in the above-identified patent and that said Letters Patent is hereby corrected as shown below:

Column 8,
Line 21, "law" should read -- jaw --.

Signed and Sealed this

Second Day of November, 2004

JON W. DUDAS
*Director of the United States Patent and Trademark Office*